US011156396B2

(12) United States Patent
Gochika et al.

(10) Patent No.: US 11,156,396 B2
(45) Date of Patent: Oct. 26, 2021

(54) SIDE ACCESS PANEL FOR AN APPLIANCE

(71) Applicant: WHIRLPOOL CORPORATION, Benton Harbor, MI (US)

(72) Inventors: Koteswara Rao Gochika, Pune (IN); Narendra A. Kapure, Pune (IN); Manjunathraddi Navalgund, Pune (IN); Manoj T. Sambrekar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/729,832

(22) Filed: Dec. 30, 2019

(65) Prior Publication Data

US 2021/0199366 A1 Jul. 1, 2021

(51) Int. Cl.

| | |
|---|---|
| ***F25D 23/00*** | (2006.01) |
| ***F25D 23/06*** | (2006.01) |
| ***F25D 23/02*** | (2006.01) |

(52) U.S. Cl.

CPC ..... *F25D 23/006* (2013.01); *F25D 23/025* (2013.01); *F25D 23/062* (2013.01); *F25D 2201/14* (2013.01)

(58) Field of Classification Search

CPC ..... F25D 23/00; F25D 23/006; F25D 23/062; F25D 23/063; F25D 23/065; F25D 23/025; F25D 19/00; F25D 2201/14

See application file for complete search history.

(56) References Cited

U.S. PATENT DOCUMENTS

| | | | | |
|---|---|---|---|---|
| 2,112,599 | A | 3/1938 | Heitman | |
| 6,629,429 | B1 * | 10/2003 | Kawamura | F25D 17/065 62/441 |
| 9,939,189 | B2 | 4/2018 | Koo et al. | |
| 10,126,039 | B2 | 11/2018 | Boehringer et al. | |
| 10,174,988 | B2 | 1/2019 | Heinrich et al. | |
| 2019/0162463 | A1 * | 5/2019 | Chen | F25D 23/006 |
| 2020/0141629 | A1 * | 5/2020 | Seo | F25D 23/003 |

FOREIGN PATENT DOCUMENTS

| | | | | |
|---|---|---|---|---|
| EP | 2878905 | A1 | 6/2015 | |
| JP | 2007017044 | A * | 1/2007 | |
| WO | 2009041778 | A2 | 4/2009 | |
| WO | WO-2012113630 | A2 * | 8/2012 | F25D 23/006 |
| WO | 2014201892 | A1 | 12/2014 | |
| WO | WO-2017145691 | A1 * | 8/2017 | F25D 23/00 |
| WO | 2018164661 | A1 | 9/2018 | |

* cited by examiner

*Primary Examiner* — Andrew M Roersma
(74) *Attorney, Agent, or Firm* — Price Heneveld LLP

(57) ABSTRACT

An appliance cabinet includes first and second sidewalls. A rear wall is disposed between the first and second sidewalls. A machine compartment is defined by a lower portion of the rear wall. An attachment feature defines openings and is coupled to at least one of the first and second sidewalls. A side access panel is selectively coupled to at least one of the first and second sidewalls via fasteners extending through the openings defined by the attachment feature.

17 Claims, 10 Drawing Sheets

SIDE ACCESS PANEL FOR AN APPLIANCE

BACKGROUND OF THE DISCLOSURE

The present disclosure generally relates to an appliance, and more specifically, to a side access panel for an appliance.

SUMMARY OF THE DISCLOSURE

According to one aspect of the present disclosure, an appliance includes a base and a wrapper coupled to the base. The wrapper has a rear planar surface and a curved surface. A machine compartment is defined by the base and the curved surface of the wrapper. An attachment feature is operably coupled to the curved surface of the wrapper. A side access panel is operably coupled to the attachment feature. The side access panel includes a brim extending toward the machine compartment, a base edge proximate to the base, an arcuate portion defines apertures and is operably coupled to the attachment feature, and a central body has an interior surface and an exterior surface. The interior surface defines support ribs. A controller is operably coupled to the interior surface of the side access panel.

According to another aspect of the present disclosure, an appliance cabinet includes a body having a rear planar surface and a curved surface that at least partially defines a machine compartment. A base is coupled to the body. An attachment feature is coupled to the curved surface of the body. The attachment feature defines a retention slot, and a side access panel is operably coupled to the attachment feature. The side access panel includes a central body and a retention tab is operably coupled to the retention slot.

According to yet another aspect of the present disclosure, an appliance cabinet includes first and second sidewalls. A rear wall is disposed between the first and second sidewalls. A machine compartment is defined by a lower portion of the rear wall. An attachment feature defines openings and is coupled to at least one of the first and second sidewalls. A side access panel is selectively coupled to at least one of the first and second sidewalls via fasteners extending through the openings defined by the attachment feature.

These and other features, advantages, and objects of the present disclosure will be further understood and appreciated by those skilled in the art by reference to the following specification, claims, and appended drawings.

Figure 1:
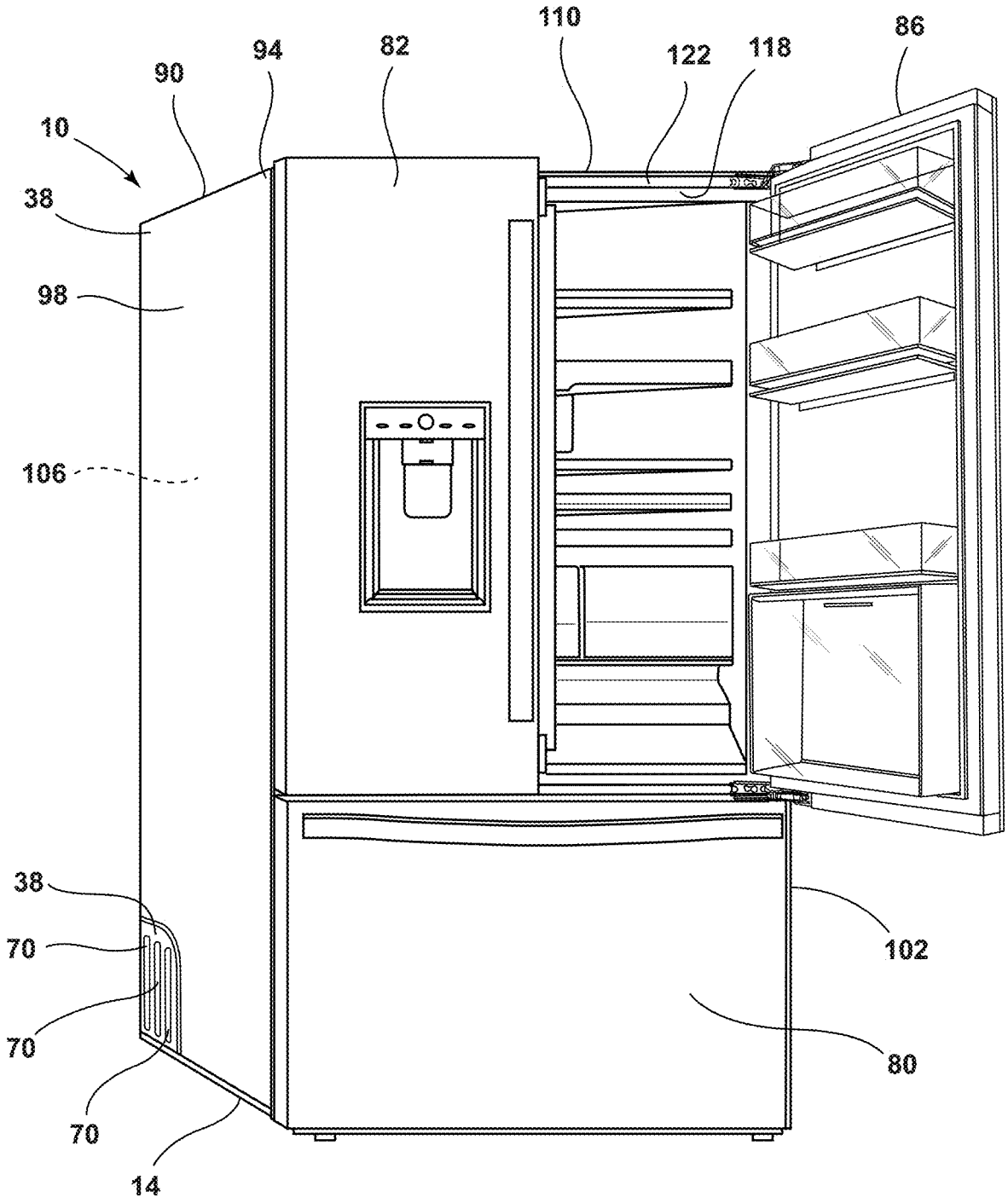
FIG. 1 is a front side perspective view of an appliance of the present disclosure.

The components in the figures are not necessarily to scale, emphasis instead being placed upon illustrating the principles described herein.

DETAILED DESCRIPTION

The present illustrated embodiments reside primarily in combinations of apparatus components related to a side access panel for an appliance. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Typically, a conventional appliance will define a machine compartment that is covered by a rear surface of the conventional appliance. In order to service machine components within the machine compartment, the rear surface of the conventional appliance must be removed and the appliance must be at least partially rotated so as to access the machine compartment. The side access panel described herein is advantageously, removably coupled to the side of an appliance, such that the machine compartment may be accessed without rotating the appliance.

Referring to FIGS. 1-10, reference numeral 10 generally designates an appliance. The appliance 10 includes a base 14 and a wrapper 18 coupled to the base 14. The wrapper 18 has a rear planar surface 22 and a curved surface 26. A machine compartment 30 is defined by the base 14 and the curved surface 26 of the wrapper 18. An attachment feature 34 is operably coupled to the curved surface 26 of the wrapper 18. A side access panel 38 is operably coupled to the attachment feature 34. The side access panel 38 includes a brim 42 that extends toward the machine compartment 30 and a base edge 46 proximate to the base 14. The side access panel 38 also includes an arcuate portion 50 that defines apertures 54. The arcuate portion 50 is operably coupled to the attachment feature 34. A central body 58 of the side access panel 38 has an interior surface 62 and an exterior surface 66. The interior surface 62 defines support ribs 70. A controller 74 is operably coupled to the interior surface 62 of the side access panel 38.

Referring to FIGS. 1-4, the appliance 10 is illustrated as a refrigerating appliance, but it is also contemplated that the side access panel 38 described herein may be used with a variety of appliances. The appliance 10 is illustrated as a French door style refrigerator with a bottom-mounted drawer 80. In addition to the bottom-mounted drawer 80, the appliance 10 includes first and second doors 82, 86 hingedly coupled to a body 88 of the appliance 10. As described herein, the term body 88 may include similar features as the wrapper 18, such as the rear planar surface 22 and the curved surface 26. Additionally or alternatively, the body 88 can be defined by a cabinet 90 which is covered by an outer casing 94, which includes first and second side panels 98, 102, a rear panel 106, and a top panel 110. Each panel 98, 102, 106, 110 may be formed from a metallic material, plastic material, or other materials typically used to form the outer casing 94 of an appliance 10.

Figure 2:
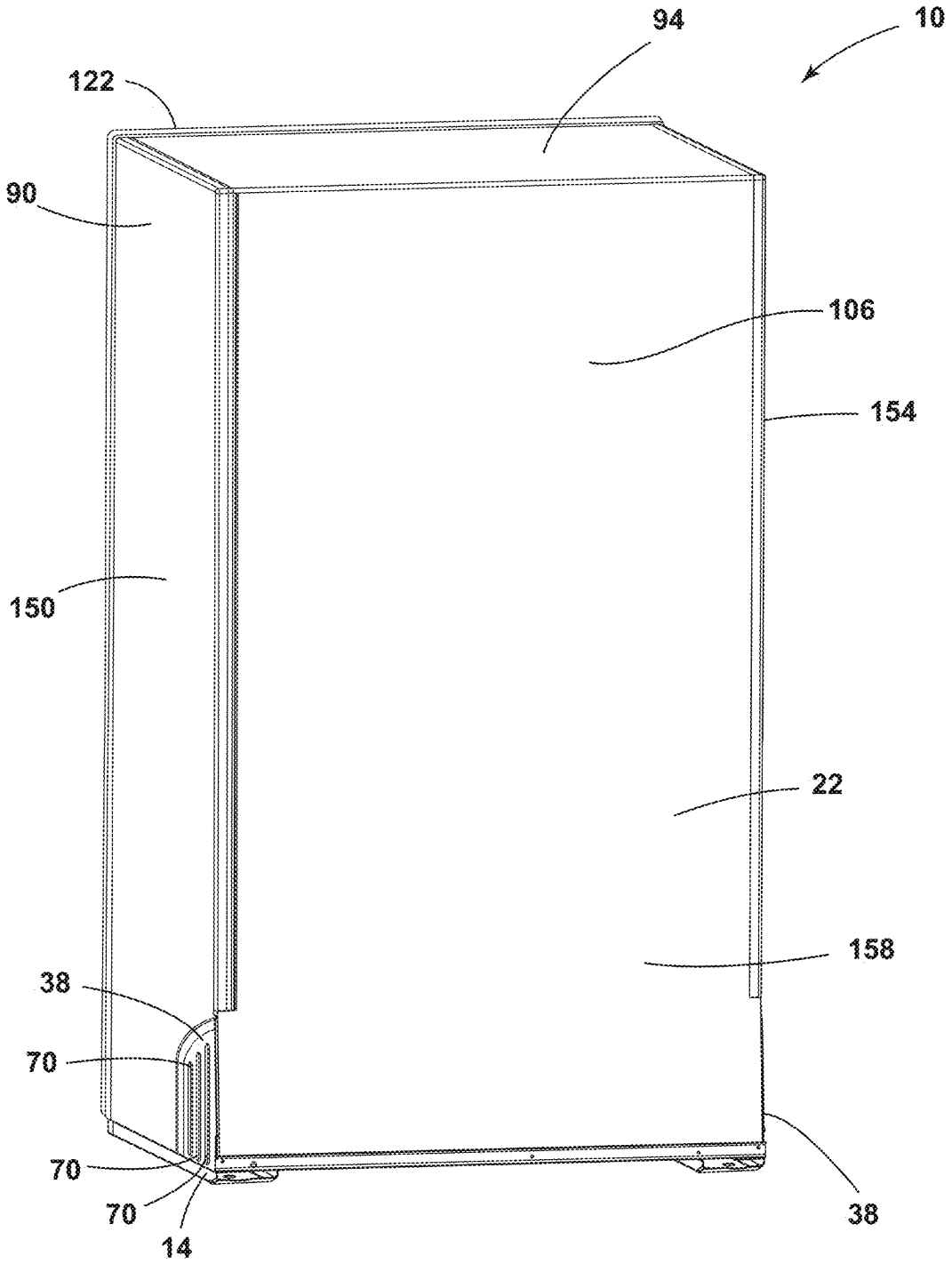
FIG. 2 is a rear side perspective view of the appliance of FIG. 1.

With reference to the construction illustrated in FIGS. 1 and 2, the outer casing 94 covers an insulated structure 114, which includes the wrapper 18 and a liner 118 to which the wrapper 18 is coupled. Stated differently, the insulated structure 114 is defined by the liner 118 and the wrapper 18. When forming the insulated structure 114, the liner 118 and the wrapper 18 are typically coupled to a trim breaker 122 to define an insulating cavity 126 therebetween in which one or more insulation materials 130 may be disposed. It is generally contemplated that the insulation materials 130 may be a glass type material, a carbon-based powder, silicone oxide-based materials, insulating gases, and other standard insulation materials 130 known in the art. The insulation materials 130 substantially fill the insulating cavity 126 to form a substantially continuous layer between the liner 118 and the wrapper 18. The insulating cavity 126 is evacuated by a vacuum to further define the insulated structure 114 as a vacuum insulated structure 114.

It is generally contemplated that the wrapper 18 and the liner 118 may be formed from metals, polymers, metal alloys, combinations thereof, and other substantially rigid materials that can be used for vacuum insulated structures within appliances. As illustrated, holes 140 are defined by the wrapper 18 and the liner 118 to allow electrical wiring and other typical appliance lines to pass through the holes 140. For purposes of this disclosure, the wrapper 18 is described in detail; however, the liner 118 can be similarly constructed insofar as the liner 118 and the wrapper 18 generally have a similar shape to form the insulated structure 114. The wrapper 18 defines top and bottom surfaces 142, 146, the rear planar surface 22, and the curved surface 26 as well as first and second sidewalls 150, 154 of the appliance cabinet 90. In general, the rear planar surface 22 corresponds to a rear wall 156 of the appliance cabinet 90. The curved surface 26 and a lower portion 158 of the rear panel 106 at least partially define the machine compartment 30, such that machine components can be positioned beneath the rear planar surface 22 and curved surface 26 of the wrapper 18 within the machine compartment 30. Typically, the insulated structure 114, and consequently the wrapper 18, is concealed by the outer casing 94 of the appliance 10. Accordingly, the rear planar surface 22 of the wrapper 18 generally corresponds to the rear panel 106 of the appliance cabinet 90.

Figure 3:
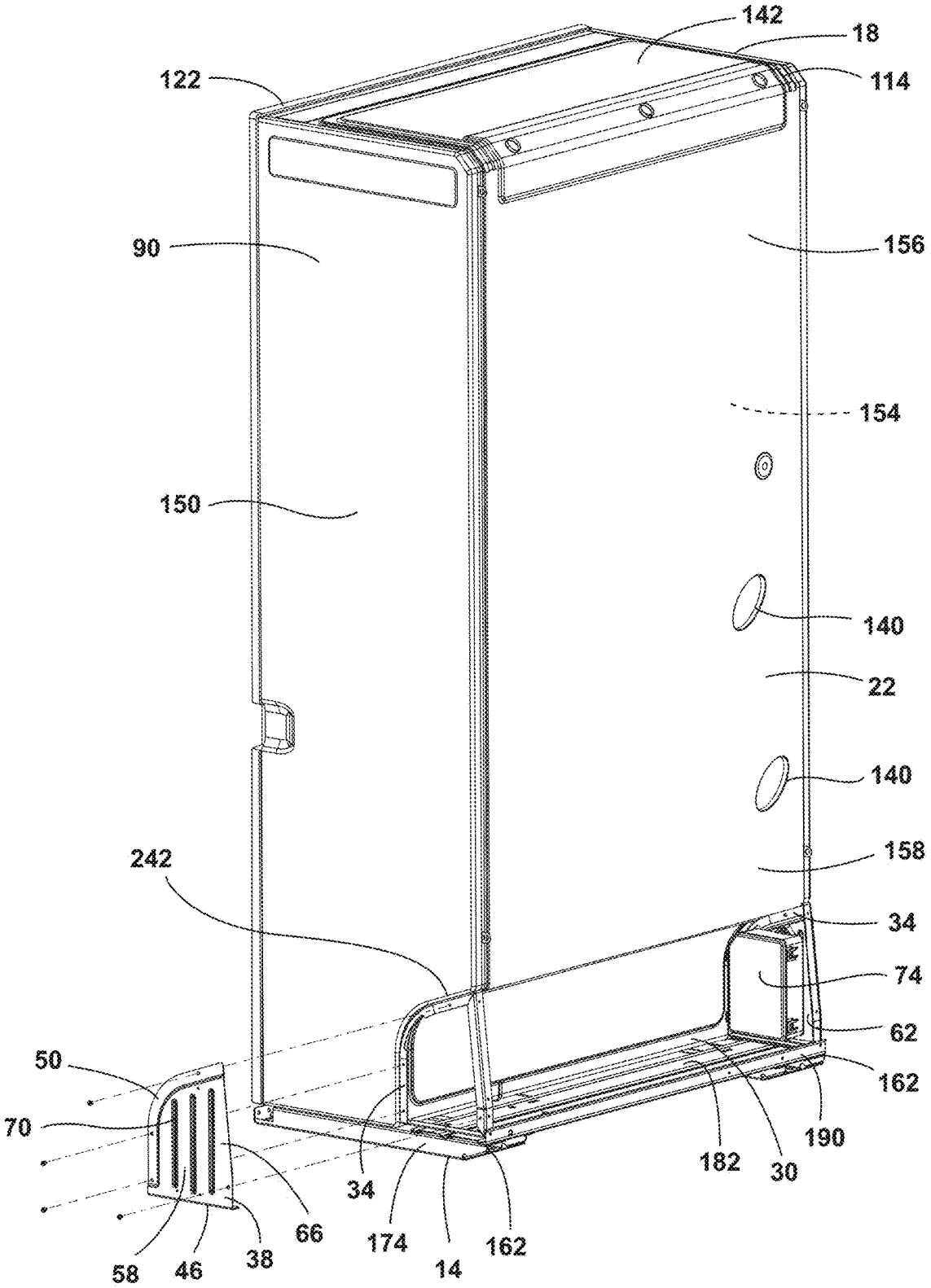
FIG. 3 is a partial exploded side perspective view of an insulated structure with a side access panel of the present disclosure.
Figure 4:
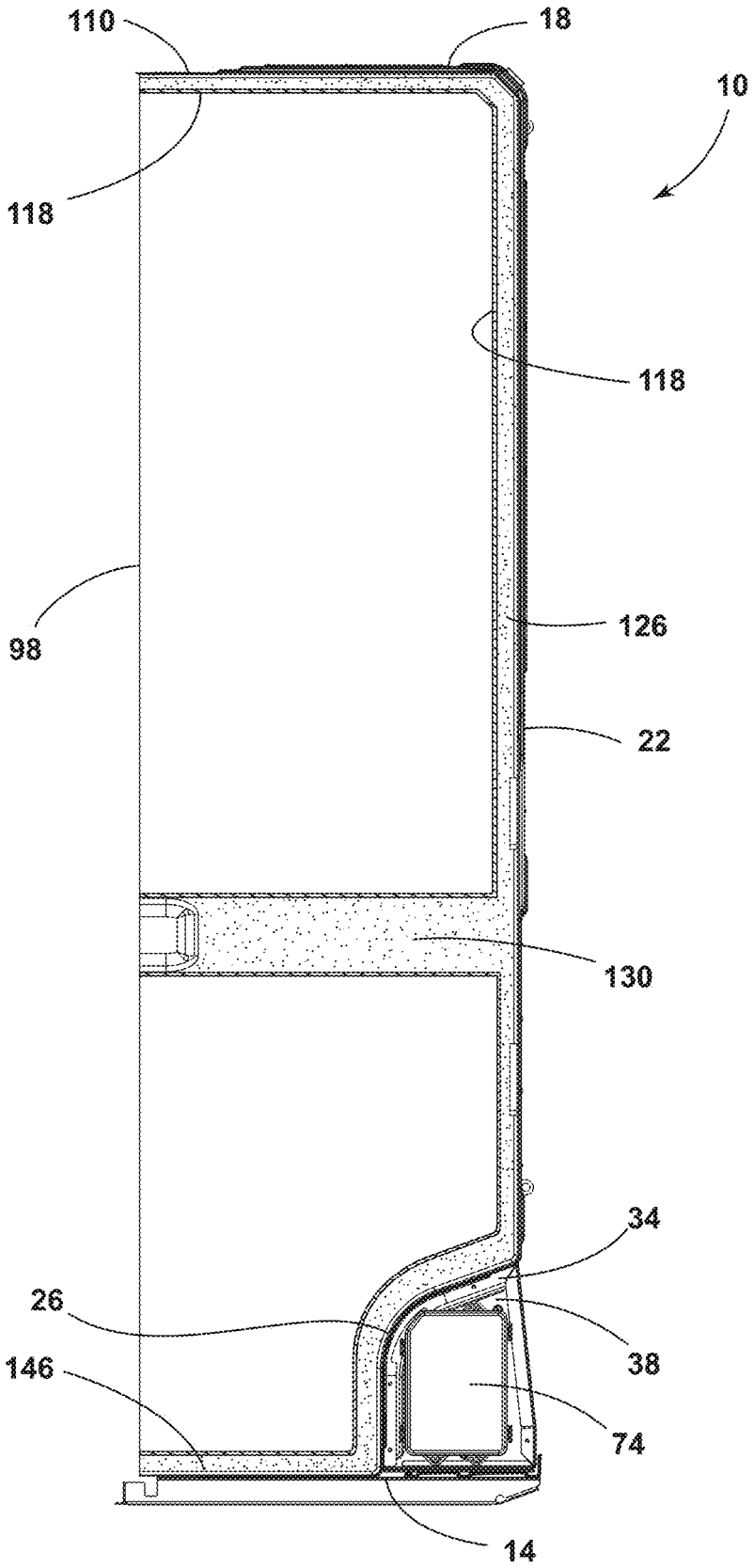
FIG. 4 is a side cross-sectional view of the insulated structure of FIG. 3.
Figure 5:
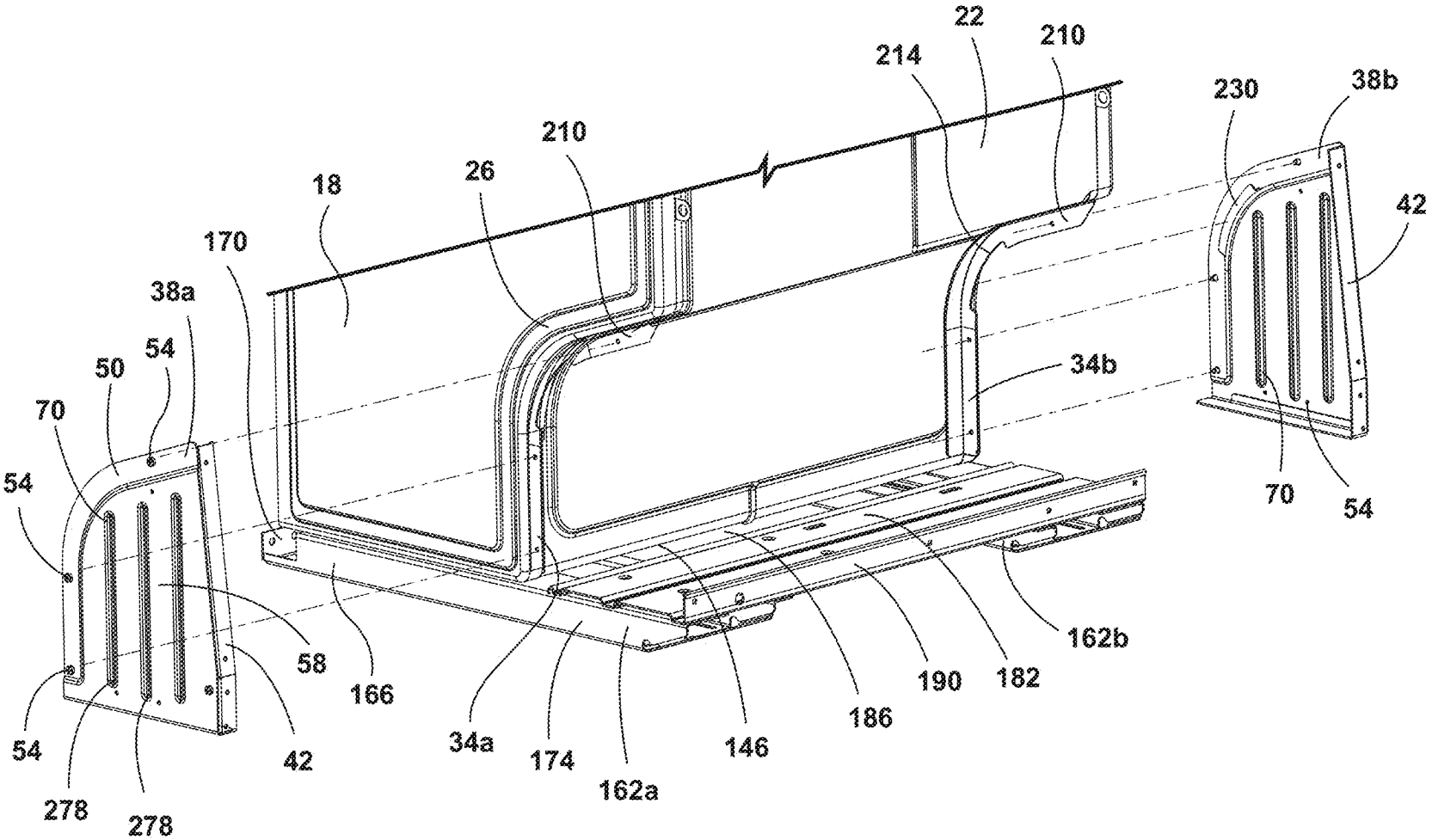
FIG. 5 is an exploded partial rear perspective view of an appliance of the present disclosure with side access panels and attachment features detached.
Figure 6:
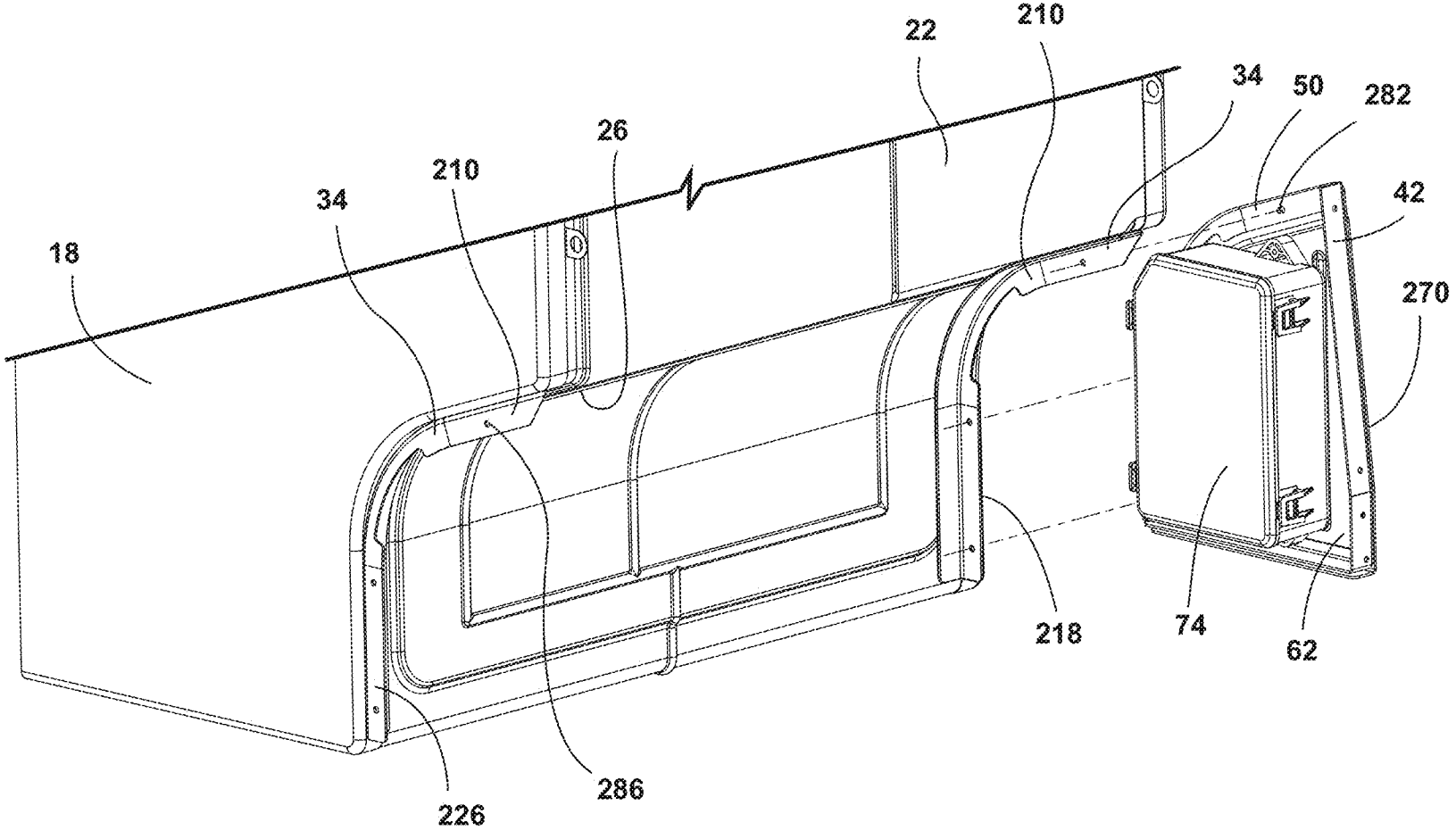
FIG. 6 is an exploded partial rear perspective view of an appliance of the present disclosure with a controller removed.

Referring to FIGS. 3, 5, and 6, the wrapper 18 is positioned on and coupled to the base 14 to structurally support the appliance 10 (FIG. 1). In addition, the outer casing 94 (FIG. 1) of the appliance 10 (FIG. 1) is typically coupled to the base 14 to cover the insulated structure 114. The base 14 may be formed from metal, plastic, or other materials known to provide structural, base support for the appliance 10 (FIG. 1). The base 14 may be a single piece of material extending across the bottom surface 146 of the wrapper 18. Additionally or alternatively, the base 14 may be rails positioned proximate to the first and second sidewalls 150, 154 of the appliance cabinet 90 and coupled to the bottom surface 146 of the wrapper 18. In either construction, the base 14 at least partially extends beyond the curved surface 26 of the wrapper 18 to lie substantially perpendicular with the rear planar surface 22 of the wrapper 18. In addition to the curved surface 26 of the wrapper 18, the machine compartment 30 is further defined by the base 14.

As illustrated in FIGS. 2 and 3, the base 14 includes a first rail 162*a* and a second rail 162*b*, which may be collectively referred to as base rails 162. A forward portion 166 of the base rails 162 includes a coupling extension 170 configured to couple to the outer casing 94 (FIG. 1) of the cabinet 90 to cover the insulated structure 114. As mentioned above, the rear portions 174 of the base rails 162 are generally disposed beneath the curved surface 26 of the wrapper 18, such that the rear portions 174 of the base rails 162 further define the machine compartment 30. A support plate 182 configured to support the machine components within the machine compartment 30 can be positioned over and coupled to the rear portion 174 of the base rails 162 to define a gap 186 therebetween. The gap 186 may provide passage for electrical wiring. For example, the controller 74 is positioned within the machine compartment 30 and may contain electrical wiring that may extend through the gap 186 beneath the wrapper 18. Additionally or alternatively, when the appliance 10 is a refrigerator and/or freezer, water lines connected to the appliance 10 may pass through the gap 186 defined by the base rails 162 and the support plate 182.

With further reference to FIGS. 3, 5, and 6, a lip 190 of the support plate 182 extends upwardly toward the rear planar surface 22 of the wrapper 18, such that the lip 190 and the rear panel 106 of the outer casing 94 at least partially enclose the machine compartment 30. The at least partial closure of the machine compartment 30 by the lip 190 and the rear panel 106 (FIG. 2) of the outer casing 94 (FIG. 2) minimizes access to the machine components within the machine compartment 30. Typically, the machine compartment 30 is entirely covered by the rear panel 106 (FIG. 2) and the lip 190. Accordingly, servicing of the machine components in conventional appliances results in the removal of the rear panel 106 (FIG. 2) and at least the movement of the appliance 10 (FIG. 2) to access the machine compartment 30 from a rear orientation of the appliance 10 (FIG. 2). To improve accessibility to the machine compartment 30, the side access panel 38 is removably coupled to the appliance 10 at the attachment feature 34 to provide access into the machine compartment 30, discussed in further detail below.

Figure 7:
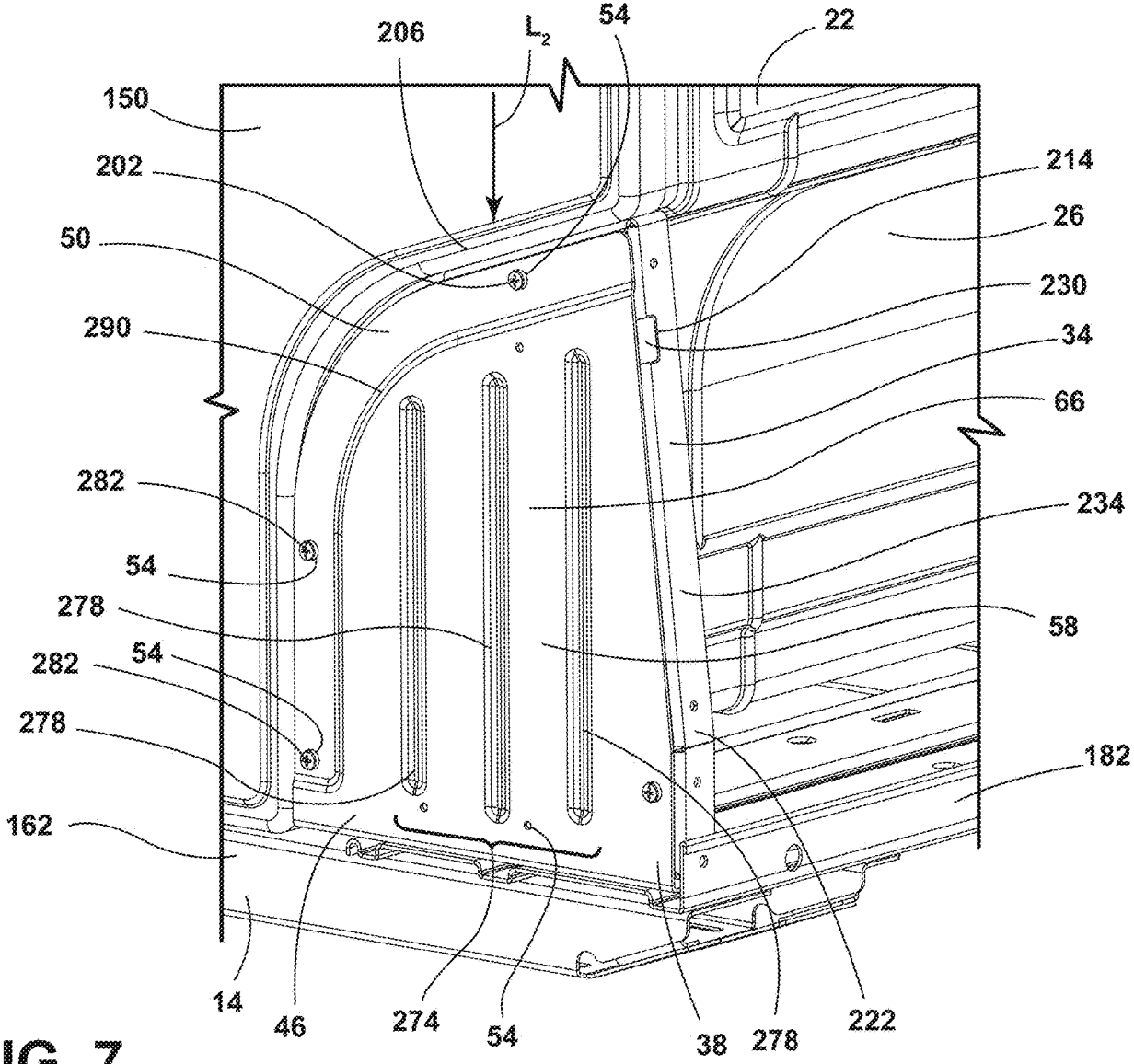
FIG. 7 is an enlarged partial perspective view of an appliance with a side access panel of the present disclosure.
Figure 9:
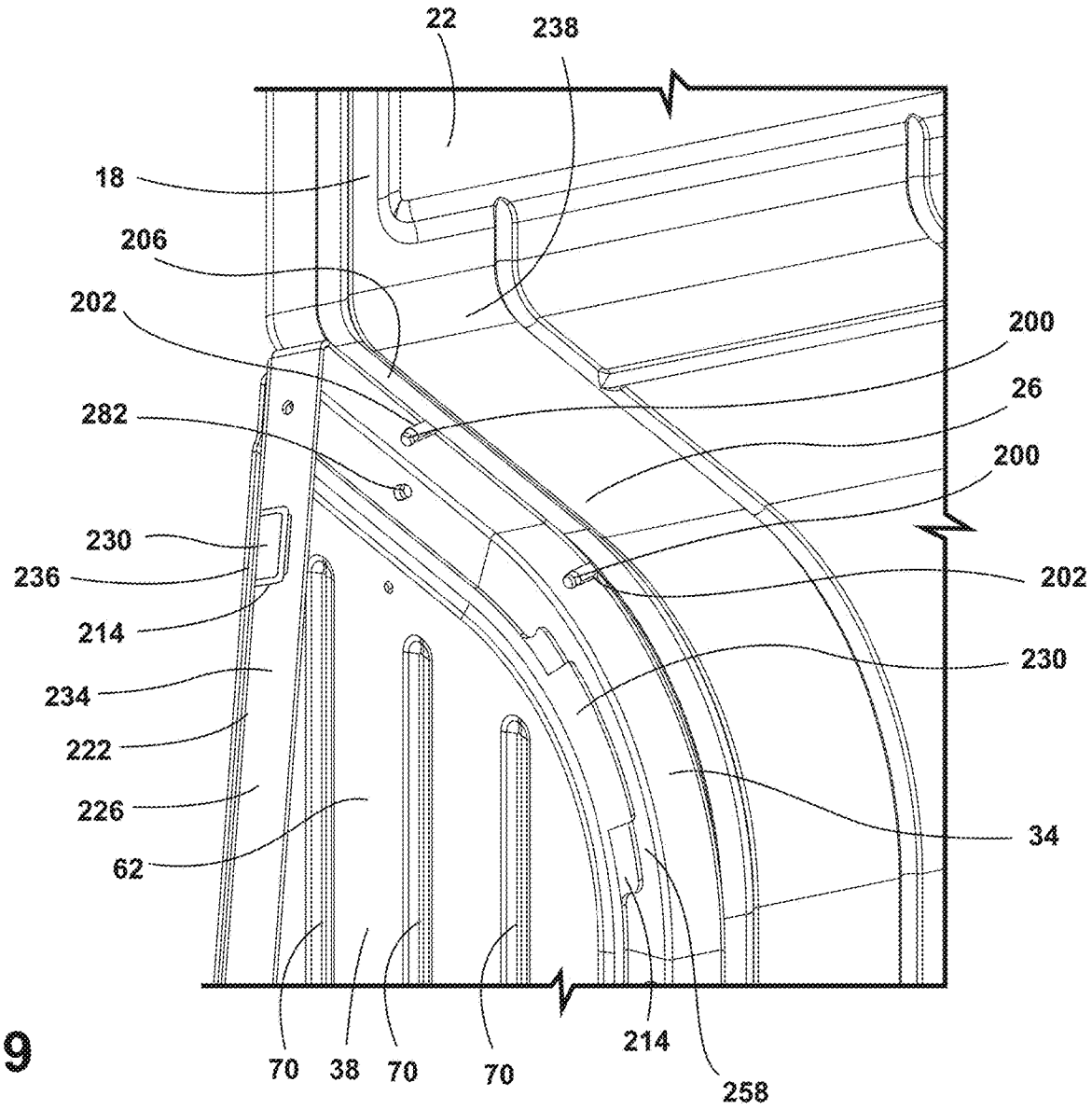
FIG. 9 is a partial top perspective view of an interior surface of a side access panel and an attachment feature of the present disclosure.

Referring to FIGS. 5, 7, and 9, the attachment feature 34 is configured to removably couple the side access panel 38 to the curved surface 26, such that as the attachment feature 34 extends along the curved surface 26 of the wrapper 18 as does the side access panel 38. The curved surface 26 of the wrapper 18 defines projections 200 that outwardly extend toward the machine compartment 30. The attachment feature 34 is coupled to the wrapper 18 at the curved surface 26 by coupling features 202 which couple to the projections 200 defined by the curved surface 26. The coupling features 202 of the attachment feature 34 may snap-fit with the projections 200 so the attachment feature 34 may be removed from the curved surface 26. Accordingly, when the side access panel 38 is removed, the attachment feature 34 may also be removed to provide additional access into the machine compartment 30. Additionally or alternatively, the attachment feature 34 may be welded to the wrapper 18 so that, while the side access panel 38 is removable, the attachment features 34 are securely coupled to the wrapper 18. In general, the attachment features 34 extend along and are disposed upon a peripheral edge 206 of the curved surface 26, such that the attachment feature 34 is operably coupled to the edge 206 of the curved surface 26.

As illustrated in FIG. 6, the attachment feature 34 is a bracket 210 that extends along the peripheral edge 206 of the curved surface 26. It is generally contemplated that the bracket 210 at least partially defines a substantially similar shape as the curved surface 26 of the wrapper 18, such that the bracket 210 has a generally arched shape that follows the curvature of the curved surface 26. In addition, when the attachment feature 34 is in the bracket 210 configuration, the side access panel 38 is coupled to the attachment feature 34 at the arcuate portion 50 of the side access panel 38. The remainder of the side access panel 38 is coupled to the base 14 of the appliance 10. Thus, the side access panel 38 may be removed from the attachment feature 34 and the base 14 to provide selective access into the machine compartment 30.

Figure 8:
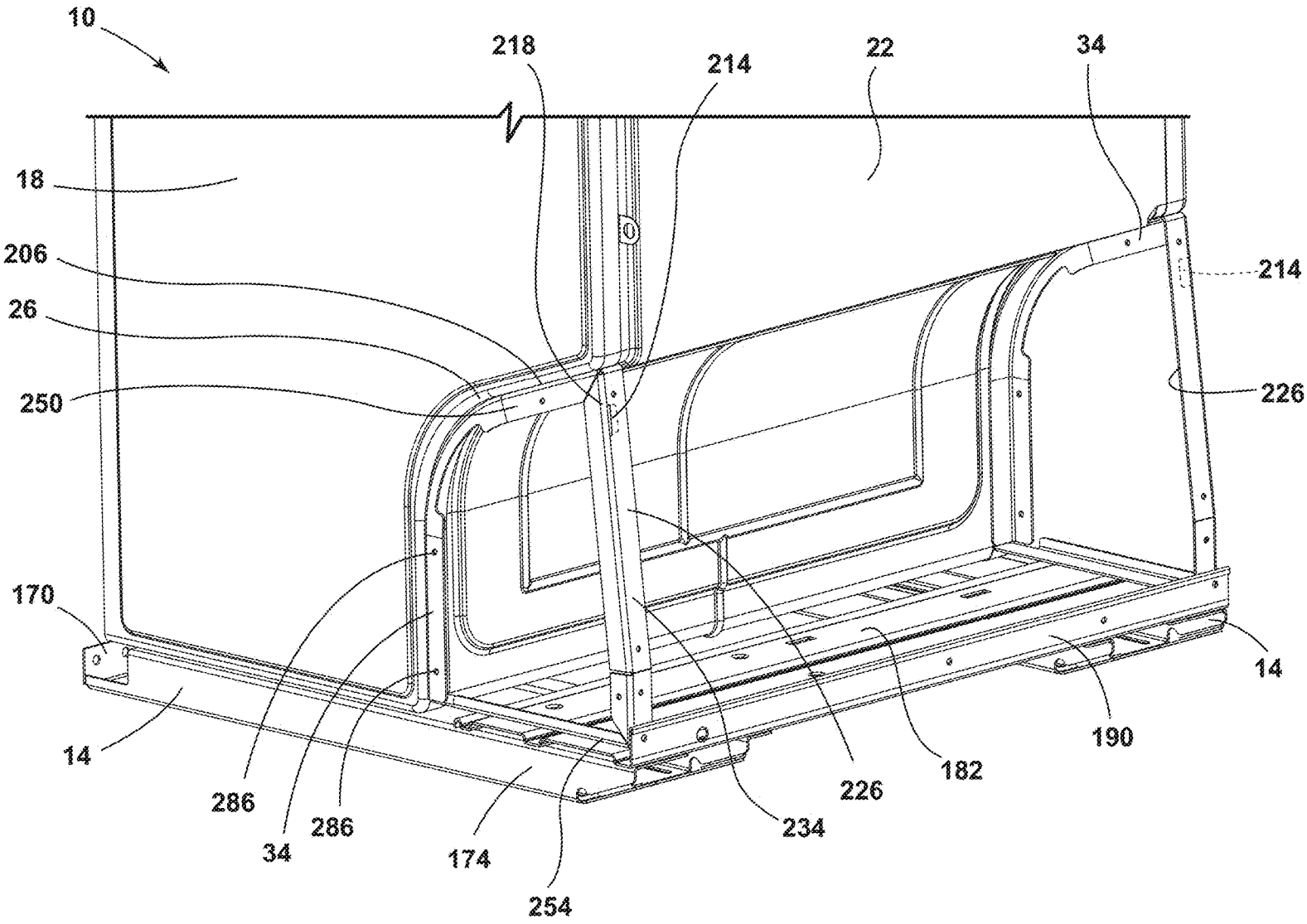
FIG. 8 is a partial rear perspective view of a wrapper and frames for an appliance of the present disclosure.

Referring to FIGS. 7-10, the attachment feature 34 includes retention slots 214 defined along a perimeter 218 of the attachment feature 34, discussed in further detail below. As illustrated in FIG. 8, the attachment feature 34 defines a frame 222 that extends along the curved surface 26 of the wrapper 18 and is adjacent to the lip 190 of the support plate 182 to generally define a D-frame construction. It is generally contemplated that the frame 222 defines flanges 226 that extend inward toward the machine compartment 30 in which the retention slots 214 may be defined. The side access panel 38 has retention tabs 230 that may inwardly extend from the central body 58 toward the machine compartment 30 and removably couple to the attachment features 34 via the retention slots 214. The retention slots 214 may be defined in a reinforcement segment 234 of the frame 222 so the side access panel 38 may couple to the retention slots 214 defined therein. As illustrated in FIG. 7, the retention tabs 230 of the side access panel 38 are disposed along an outer edge 236 of the side access panel 38. In such construction, the retention tabs 230 are configured to couple to the retention slots 214 defined within the reinforcement segment 234 of the attachment feature 34. As mentioned above, it is generally contemplated that the brim 42 may be defined as the retention tabs 230 that extend toward the machine compartment 30 from the outer edge 236 of the side access panel 38.

The frame 222 can at least partially provide additional structural support for the wrapper 18. For example, the reinforcement segment 234 of the frame 222 lies in a similar plane as the rear planar surface 22 of the wrapper 18, such that the reinforcement segment 234 of the frame 222 at least partially supports the wrapper 18 as an extension of the rear planar surface 22. In providing additional structural support, the frame 222 is coupled to the base 14 and may generally brace against an upper portion 238 of the curved surface 26 to further support a rear section 242 of the wrapper 18.

Figure 10:
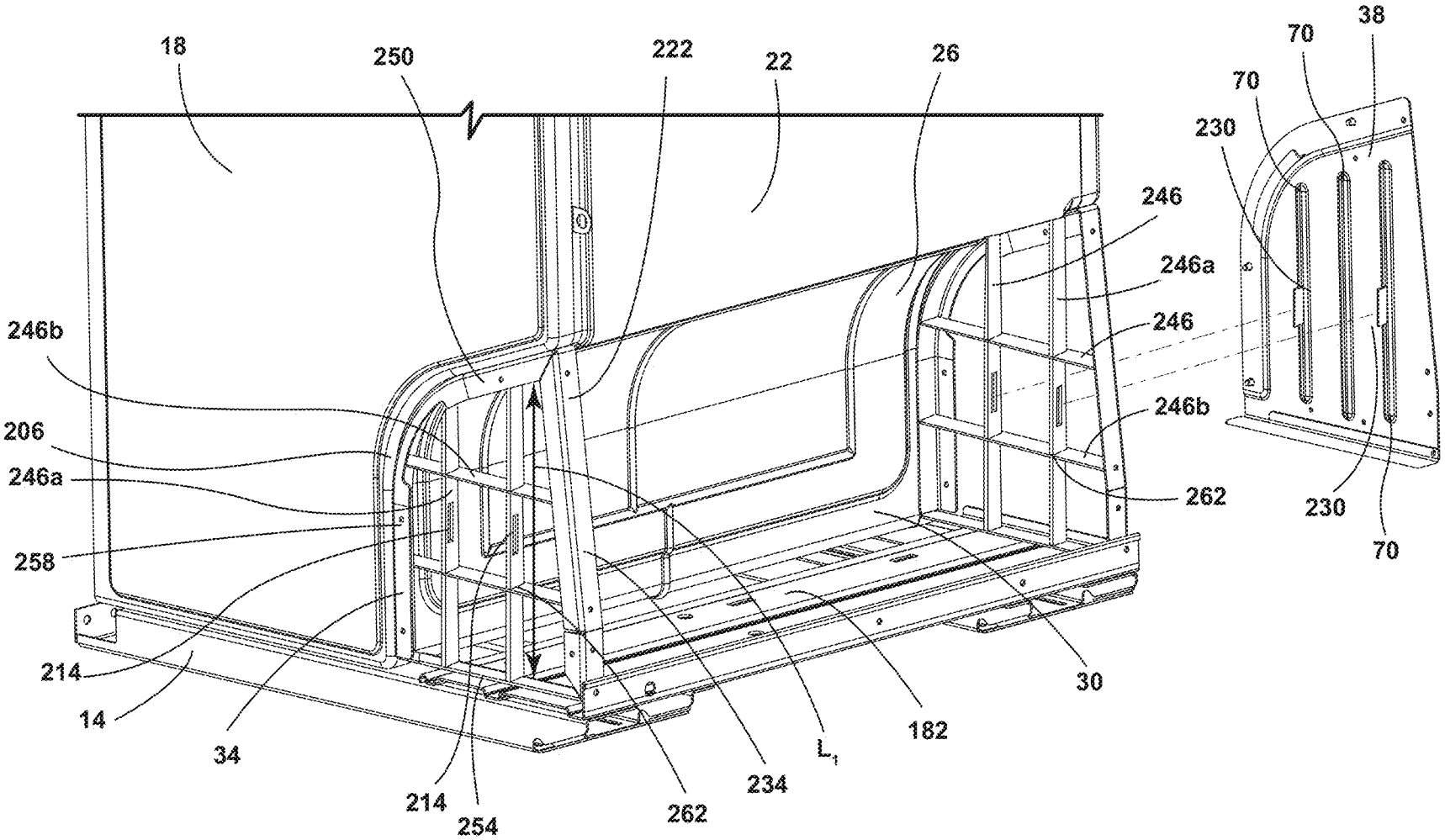
FIG. 10 is a partial exploded view of a side access panel of the present disclosure that has a lattice structure.

With further reference to FIGS. 7-10, supports 246 may extend from a top 250 of the frame 222 to a bottom 254 of the frame 222. The supports 246 may also extend from an arcuate edge 258 of the frame 222 to the reinforcement segment 234 of the frame 222 to generally define a lattice structure 262 that has vertical and horizontal supports 246*a*, 246*b*. It is generally contemplated that the vertical supports 246*a* of the frame 222 may alternatively define the retention slots 214, such that the side access panel 38 may couple to the retention slots 214 defined in the vertical supports 246*a*. The side access panel 38 may be coupled to the vertical supports 246*a* of the frame 222 of the attachment feature 34. As illustrated in FIG. 10, the vertical supports 246*a* define the retention slots 214 along a length $L_1$ of the vertical supports 246*a*. The support ribs 70 defined by the central body 58 of the side access panel 38 may project inward toward the machine compartment 30 and can be coupled to the retention slots 214 defined by the vertical supports 246*a* of the attachment feature 34. By way of example, not limitation, the support ribs 70 can define the retention tabs 230 that extend through the retention slots 214 to removably couple the side access panel 38 to the attachment feature 34.

A grasping portion 274 may be defined on the exterior surface 66 of the central body 58 by defined grooves 278 that correspond with the support ribs 70 on the interior surface 62 of the central body 58. The grooves 278 identify the support ribs 70 so a user can grasp the grooves 278 to remove the side access panel 38 from the attachment feature 34. While the side access panel 38 may be coupled to the attachment feature 34 by the retention slots 214 and the retention tabs 230, the side access panel 38 may also be coupled to the attachment feature 34 via fasteners 282. The fasteners 282 extend through the apertures 54 defined by the side access panel 38 and coupled to the attachment feature 34 through openings 286. The use of both the retention slots 214 and retention tabs 230, in addition to the fasteners 282, securely couples the side access panel 38 to the wrapper 18 while maintaining the removability of the side access panel 38 from the attachment feature 34 to provide access into the machine compartment 30. Additional apertures 54 may be defined by the central body 58 of the side access panel 38 so the controller 74 may be coupled to the interior surface 62 of the side access panel 38 by additional fasteners 282. Additionally or alternatively, the controller 74 may be coupled to the supports 246 of the frame 222.

With further reference to FIGS. 7-10, when the side access panel 38 is coupled to the attachment feature 34 via the retention tabs 230, the side access panel 38 may be easily removed from the attachment feature 34 such that the side access panel 38 provides selective access to the machine compartment 30 from the side of the appliance 10. Similar to the support provided by the frame 222 of the attachment feature 34, the side access panel 38 further includes an arcuate support rib 290 positioned between an edge of the arcuate portion 50 of the side access panel 38 and the central body 58. The arcuate support rib 290 may absorb and disperse a load $L_2$ that may be placed upon the side access panel 38 when coupled to the wrapper 18. It is generally contemplated that the arcuate support rib 290 deflects a greater amount of the load $L_2$ placed upon the side access panel 38 from the wrapper 18 when the attachment feature 34 is in the bracket 210 (FIG. 6) configuration. It is understood that while the side access panel 38 may provide load $L_2$ bearing support it is minimal with respect to other features described herein, such as the base 14.

With reference again to FIGS. 1-10, it is also contemplated that the side access panel 38 may include first and second side access panels 38*a*, 38*b* that are coupled to first and second attachment features 34*a*, 34*b*. Accordingly, the first attachment feature 34*a* removably couples the first side access panel 38*a* to the first sidewall 150, and the second attachment feature 34*b* removably couples the second side access panel 38*b* to the second sidewall 154. While described herein that the attachment feature 34 is coupled to the wrapper 18, it is also contemplated that the attachment feature 34 may be coupled to the at least one of the side panels 98, 102 of the outer casing 94. In such configuration, the curved surface 26 may be defined by the side panels 98, 102, such that the arcuate edge 258 of the attachment feature 34 is operably coupled to the curved surface 26 defined by the first and second side panels 98, 102 of the outer casing 94.

While the side access panel 38 provides selective access to machine compartment 30 through the sidewall of the appliance cabinet 90, it also provides a cost-effective way of forming the insulated structure 114, as the side access panel 38 is separate from the insulating structure 114 minimizing the overall cost of production of the appliance 10. In conventional insulating structures, the sides of the wrapper 18 extend from the top surface 142 to the bottom surface 146 to define a generally rectangular shape. Thus, conventional insulated structures utilize insulated materials in greater proportion than the insulated structure 114 described herein. Accordingly, by incorporating the side access panel 38, the cost of production is minimized as fewer insulation materials 130 are used in the side panels 98, 102 of the insulated structure 114. Therefore, the side access panel 38 provides both minimized cost in addition to selective access into the machine compartment 30.

The invention disclosed herein is further summarized in the following paragraphs and is further characterized by combinations of any and all of the various aspects described therein.

According to one aspect of the present disclosure, an appliance includes a base and a wrapper coupled to the base. The wrapper has a rear planar surface and a curved surface. A machine compartment is defined by the base and the curved surface of the wrapper. An attachment feature is operably coupled to the curved surface of the wrapper. A side access panel is operably coupled to the attachment feature. The side access panel includes a brim extending toward the machine compartment, a base edge proximate to the base, an arcuate portion defines apertures and is operably coupled to the attachment feature, and a central body has an interior surface and an exterior surface. The interior surface defines support ribs. A controller is operably coupled to the interior surface of the side access panel.

According to another aspect, an attachment feature includes a frame and a support that extends between a top and a bottom of the frame. The frame is operably coupled to a curved surface and a base.

According to still another aspect, a side access panel includes a retention tab that is removably coupled to a frame to provide selective access to a machine compartment.

According to yet another aspect, a wrapper includes projections outwardly extending from a curved surface toward a machine compartment. An attachment feature includes coupling features that couple to the projections.

According to another aspect, a side access panel further includes an arcuate support rib that is positioned between an edge of an arcuate portion and a central body.

According to yet another aspect, an exterior surface of a central body defines a grasping portion of a side access panel.

According to still another aspect, an attachment feature is a bracket that partially extends along a peripheral edge of a curved surface.

According to another aspect of the present disclosure, an appliance cabinet includes a body having a rear planar surface and a curved surface that at least partially defines a machine compartment. A base is coupled to the body. An attachment feature is coupled to the curved surface of the body. The attachment feature defines a retention slot, and a side access panel is operably coupled to the attachment feature. The side access panel includes a central body and a retention tab is operably coupled to the attachment feature via the retention slot.

According to another aspect, a controller is coupled to an interior surface of a side access panel.

According to yet another aspect, an attachment feature is disposed along an edge of a curved surface.

According to still another aspect, an attachment feature is a frame and a retention slot is defined along a perimeter of the frame.

According to another aspect, a body defines a vacuum insulated structure.

According to still another aspect, a side access panel has an arcuate portion that is selectively coupled to an attachment feature. The attachment feature is operably coupled to an edge of a curved surface.

According to yet another aspect, an attachment feature includes supports that extend from a top of an attachment feature to a bottom of the attachment feature, wherein a retention slot is defined along each of the supports.

According to yet another aspect of the present disclosure, an appliance cabinet includes first and second sidewalls. A rear wall is disposed between the first and second sidewalls. A machine compartment is defined by a lower portion of the rear wall. An attachment feature defines openings and is coupled to at least one of the first and second sidewalls. A side access panel is selectively coupled to at least one of the first and second sidewalls via fasteners extending through the openings defined by the attachment feature.

According to another aspect, an attachment feature further includes a first attachment feature and a second attachment feature. A side access panel further includes a first side access panel that is selectively coupled to the first attachment feature and a second side access panel is selectively coupled to the second attachment feature.

According to yet another aspect, a first attachment feature removably couples a first side access panel to a first sidewall. A second attachment feature removably couples a second side access panel to a second sidewall.

According to still another aspect, an attachment feature is a frame that defines an arcuate edge and a reinforcement segment. A frame has flanges that extend toward a machine compartment.

According to another aspect, an arcuate edge of an attachment feature is operably coupled to a curved surface that is defined by at least one of a first and a second sidewall.

According to another aspect, a frame includes supports that extend from a top of the frame to a bottom of the frame and from the arcuate edge to a reinforcement segment to define a lattice structure.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance, comprising:

a base;

a wrapper coupled to the base, the wrapper having a rear planar surface, sidewalls, and a curved surface;

a machine compartment defined by the base and the curved surface of the wrapper;

an attachment feature operably coupled to the curved surface of the wrapper;

a selectively removable side access panel operably coupled to the sidewalls of the wrapper via the attachment feature to define a single access point to the machine compartment, the side access panel including:

a brim extending toward the machine compartment;

a base edge proximate to the base;

an arcuate portion defining apertures and operably coupled to the attachment feature; and a central body having an interior surface and an exterior surface, the interior surface defining support ribs; and a controller operably coupled to the interior surface of the side access panel.

2. The appliance of claim 1, wherein the attachment feature includes a frame and a support extending between a top and a bottom of the frame, and wherein the frame is operably coupled to the curved surface and the base.

3. The appliance of claim 2, wherein the side access panel includes a retention tab removably coupled to the frame to provide selective access to the machine compartment.

4. The appliance of claim 1, wherein the wrapper includes projections outwardly extending from the curved surface toward the machine compartment, and wherein the attachment feature includes coupling features that couple to the projections.

5. The appliance of claim 1, wherein the side access panel further includes an arcuate support rib positioned between an edge of the arcuate portion and the central body.

6. The appliance of claim 1, wherein the exterior surface of the central body defines a grasping portion of the side access panel.

7. The appliance of claim 1, wherein the attachment feature is a bracket that partially extends along a peripheral edge of the curved surface.

8. An appliance cabinet, comprising:

a body having a rear planar surface, sidewalls, and a curved surface that at least partially defines a machine compartment;

a base coupled to the body;

an attachment feature coupled to the curved surface of the body, the attachment feature defining a retention slot; and a selectively removable side access panel removably coupled to the sidewalls via the attachment feature to define at least one access point to the machine compartment, the side access panel including:

a central body; and a retention tab selectively coupled to the attachment feature via the retention slot; and further comprising a controller coupled to an interior surface of the side access panel.

9. The appliance cabinet of claim 8, wherein the attachment feature is disposed along an edge of the curved surface.

10. The appliance cabinet of claim 8, wherein the attachment feature is a frame and the retention slot is defined along a perimeter of the frame.

11. The appliance cabinet of claim 8, wherein the body defines a vacuum insulated structure.

12. The appliance cabinet of claim 8, wherein the side access panel has an arcuate portion selectively coupled to the attachment feature, and wherein the attachment feature is operably coupled to an edge of the curved surface.

13. The appliance cabinet of claim 8, wherein the attachment feature includes supports extending from a top of the attachment feature to a bottom of the attachment feature, and wherein the retention slot is defined along each of the supports.

14. An appliance cabinet, comprising:

first and second sidewalls;

a rear wall disposed between the first and second sidewalls;

a machine compartment defined by a lower portion of the rear wall;

an attachment feature defining openings and coupled to at least one of the first and second sidewalls, wherein the attachment feature is a frame that defines an arcuate edge and a reinforcement segment, and wherein the frame has flanges extending toward the machine compartment, the frame including supports extending from a top of the frame to a bottom of the frame and from the arcuate edge to the reinforcement segment to define a lattice structure; and a side access panel selectively coupled to at least one of the first and second sidewalls via fasteners extending through the openings defined by the attachment feature.

15. The appliance cabinet of claim 14, wherein the attachment feature further includes a first attachment feature and a second attachment feature, and wherein the side access panel further includes a first side access panel selectively coupled to the first attachment feature and a second side access panel selectively coupled to the second attachment feature.

16. The appliance cabinet of claim 15, wherein the first attachment feature removably couples the first side access panel to the first sidewall, and wherein the second attachment feature removably couples the second side access panel to the second sidewall.

17. The appliance cabinet of claim 14, wherein the arcuate edge of the attachment feature is operably coupled to a curved surface defined by at least one of the first and second sidewalls.

* * * * *